US012535075B2

(12) United States Patent
Pekar et al.

(10) Patent No.: US 12,535,075 B2
(45) Date of Patent: Jan. 27, 2026

(54) MULTI-STAGE ELECTRIC COMPRESSOR ENERGY CONSUMPTION OPTIMIZATION

(71) Applicant: Garrett Transportation I Inc., Torrance, CA (US)

(72) Inventors: Jaroslav Pekar, Brno (CZ); Lubomir Baramov, Prague (CZ)

(73) Assignee: Garrett Transportation I Inc., Torrance, CA (US)

( * ) Notice: Subject to any disclaimer, the term of this patent is extended or adjusted under 35 U.S.C. 154(b) by 279 days.

(21) Appl. No.: 18/496,774

(22) Filed: Oct. 27, 2023

(65) Prior Publication Data

US 2025/0137458 A1 May 1, 2025

(51) Int. Cl.

| | |
|---|---|
| ***F04D 17/12*** | (2006.01) |
| ***F04D 25/06*** | (2006.01) |
| ***F04D 27/00*** | (2006.01) |

(52) U.S. Cl.

CPC ..... *F04D 17/12* (2013.01); *F04D 25/06* (2013.01); *F04D 27/00* (2013.01)

(58) Field of Classification Search

CPC ..... F04D 17/12; F04D 27/001; F04D 27/02; F04D 27/0223; F04D 25/06; F04D 27/00; F04D 25/16; F04D 27/0261; F04D 27/0269; F04B 2205/05; F04B 27/24; F04B 35/04; F04B 41/02

USPC ..... 417/2

See application file for complete search history.

(56) References Cited

U.S. PATENT DOCUMENTS

| | | | |
|---|---|---|---|
| 2,512,561 | A | 6/1950 | Ziegler |
| 2,959,029 | A | 11/1960 | Best |
| 2,981,077 | A | 4/1961 | Farkas |
| 3,047,210 | A | 7/1962 | Best |
| 3,079,121 | A | 2/1963 | Griffing |
| 3,082,609 | A | 3/1963 | Ryan et al. |
| 3,184,926 | A | 5/1965 | Blake |
| 4,347,711 | A | 9/1982 | Noe et al. |
| 4,358,929 | A | 11/1982 | Molivadas |
| 4,487,034 | A | 12/1984 | Cronin et al. |
| 4,581,903 | A | 4/1986 | Kerry |
| 5,044,167 | A | 9/1991 | Champagne |

(Continued)

FOREIGN PATENT DOCUMENTS

| | | |
|---|---|---|
| EP | 1884726 A2 | 2/2008 |
| EP | 1578664 B1 | 4/2008 |

(Continued)

OTHER PUBLICATIONS

Somvarsky, Jan et al., "Economic Load Allocation," 15th Triennial World Congress, Barcelona, Spain 2002, Elseiver IFAC Publications, pp. 293-298.

(Continued)

*Primary Examiner* — Mark A Laurenzi
*Assistant Examiner* — Benjamin Doyle
(74) *Attorney, Agent, or Firm* — BelayIP

(57) ABSTRACT

Compressed gas delivery systems and controllers. A multi-stage compressor system operation with series compressors is optimized by a controller by using inter-stage pressure as a control parameter for optimization to provide reduced power consumption. A multi-compressor system with parallel compressors is controlled using optimized operation parameters for each of several parallel compressors to provide reduced power consumption.

20 Claims, 11 Drawing Sheets

(56) References Cited

U.S. PATENT DOCUMENTS

| | | | | |
|---|---|---|---|---|
| 5,050,389 | A | 9/1991 | Wigmore et al. | |
| 5,065,590 | A | 11/1991 | Powell et al. | |
| 5,066,197 | A | 11/1991 | Champagne | |
| 5,070,706 | A | 12/1991 | Waters et al. | |
| 5,088,292 | A | 2/1992 | Champagne et al. | |
| 5,109,676 | A | 5/1992 | Waters et al. | |
| 5,174,729 | A * | 12/1992 | Waters | F04D 27/0207 417/310 |
| 5,259,210 | A | 11/1993 | Ohya et al. | |
| 5,278,772 | A | 1/1994 | Knupp | |
| 5,306,116 | A * | 4/1994 | Gunn | F04D 27/0207 415/17 |
| 5,735,134 | A | 4/1998 | Liu et al. | |
| 5,771,703 | A | 6/1998 | Rajendran | |
| 6,318,101 | B1 | 11/2001 | Pham et al. | |
| 6,321,549 | B1 | 11/2001 | Reason et al. | |
| 6,843,067 | B2 | 1/2005 | Lee et al. | |
| 6,854,285 | B2 | 2/2005 | Jessen | |
| 7,044,716 | B2 * | 5/2006 | Fabry | F04D 27/02 417/244 |
| 7,134,291 | B2 | 11/2006 | Horan et al. | |
| 7,784,296 | B2 | 8/2010 | Chen et al. | |
| 8,365,550 | B2 * | 2/2013 | Vogel | B64D 13/06 62/401 |
| 11,215,182 | B2 * | 1/2022 | Hartman | F25B 1/10 |
| 11,442,437 | B2 | 9/2022 | Urich et al. | |
| 11,635,091 | B2 | 4/2023 | Zug et al. | |
| 11,656,612 | B2 | 5/2023 | Espie et al. | |
| 2004/0093124 | A1 | 5/2004 | Havlena | |
| 2006/0162358 | A1 | 7/2006 | VanderZee | |
| 2007/0113568 | A1 | 5/2007 | Jang et al. | |
| 2007/0113579 | A1 | 5/2007 | Claeys et al. | |
| 2008/0023563 | A1 | 1/2008 | Tamura | |
| 2008/0264084 | A1 | 10/2008 | Derouineau et al. | |
| 2009/0031740 | A1 | 2/2009 | Douglas | |
| 2012/0087810 | A1 * | 4/2012 | Peussa | F04D 25/06 417/338 |
| 2016/0186764 | A1 * | 6/2016 | Lissoni | F04D 17/122 417/423.1 |
| 2022/0057127 | A1 | 2/2022 | Zug et al. | |
| 2022/0178602 | A1 | 6/2022 | Zug | |
| 2023/0060903 | A1 | 3/2023 | Kishi et al. | |
| 2023/0417235 | A1 * | 12/2023 | Walsh | F04B 49/08 |

FOREIGN PATENT DOCUMENTS

| | | | |
|---|---|---|---|
| EP | 1640673 | B1 | 8/2008 |
| EP | 3232283 | B1 | 10/2019 |
| EP | 3620378 | B1 | 11/2021 |
| EP | 3323727 | B1 | 3/2022 |
| WO | 2006110165 | A3 | 12/2006 |
| WO | 2022185110 | A1 | 9/2022 |

OTHER PUBLICATIONS

U.S. Appl. No. 18/391,344, filed Dec. 20, 2023.

* cited by examiner

300

| Config. | C1 | C2 | C3 | M [kg/sec] | Eff = P/m [kWh/kg] |
|---|---|---|---|---|---|
| 0 | off | off | off | M0 = 0 | --- |
| 1 | on | off | off | M1 = 0.15 | E1 = 0.0694 |
| 2 | off | on | off | M2 = 0.18 | E2 = 0.0794 |
| 3 | on | on | off | M3 = 0.33 | E3 =0.0749 |
| 4 | off | off | on | M4 = 0.21 | E4 = 0.0617 |
| 5 | on | off | on | M5 = 0.36 | E5 =0.0649 |
| 6 | off | on | on | M6 = 0.39 | E6 = 0.0749 |
| 7 | on | on | on | M* = 0.54 | E7 = 0.0697 |

302 304 306 308 310 312

Figure 10

MULTI-STAGE ELECTRIC COMPRESSOR ENERGY CONSUMPTION OPTIMIZATION

BACKGROUND

Industrial compressed air supply systems are used in many industrial production lines, laboratories and manufacturing facilities. In such systems, pressurized air is stored in air tanks and is distributed throughout a facility or building as demanded by the individual compressed air-based machines in the facility. The air is typically compressed by electric compressors of various types, for example using centrifugal compressors. Depending on target pressure and air mass flow demand, it may be necessary to use machines of various configurations, for example multiple multi-stage electric centrifugal compressors. The electric compressors are then combined in series to provide the required compressed air pressure, and/or in parallel to increase air mass flow capacity. Other configurations may use multiple compressors in parallel to one another. The compressors may run significant part of the working day and therefore cost of energy can be high. Minimizing energy use (and therefore cost) is a goal for such systems.

Overview

The present inventors have recognized, among other things, that a problem to be solved is the need for new and/or alternative control methods for industrial compressed air supply systems. The present inventors propose a method of control and optimization to minimize the operational cost of the compressed air supply system with multiple multi-stage electric centrifugal compressors.

A first illustrative and non-limiting example takes the form of a controller for multi-stage compressor system for providing pressurized gas to a tank, the tank having an outlet coupled to at least one pressurized gas consuming apparatus, the compressor system having: a first compressor having a first inlet, a first outlet, a first impeller, and a first motor coupled to the first impeller; a second compressor having a second inlet, a second outlet, a second impeller, and a second motor coupled to the second impeller; wherein the first compressor is coupled in series with the second compressor such that the first outlet feeds gas to the second inlet; wherein the controller is configured to control operation of the first and second compressors as follows: determining a requested mass flow through the compressor system; receiving a desired tank pressure and a measured ambient pressure; calculating a target interstage pressure for gas fed from the first outlet to the second inlet by minimizing a sum of power used by the first compressor to obtain a first pressure ratio of ambient pressure to target interstage pressure at the requested mass flow, and power used by the second compressor to obtain a second pressure ratio of target interstage pressure to tank pressure at the requested mass flow; and issuing control signals to the first and second compressors to yield the target interstage pressure.

Additionally or alternatively, the first and second compressors are centrifugal compressors. Additionally or alternatively, minimizing a sum of power is performed within compressor speed limits for each of the first compressor and the second compressor. Additionally or alternatively, a step of determining a requested mass flow through the compressor system is performed by the controller: receiving a requested mass flow through the system; receiving a measured mass flow through the system; and applying a proportional-integral-derivative control to calculate the requested mass flow from the requested mass flow and the measured mass flow.

Additionally or alternatively, the step of minimizing a sum of power used by the first compressor to obtain a first pressure ratio of ambient to target interstage pressure at the requested mass flow, and power used by the second compressor to obtain a second pressure ratio of target interstage pressure to tank pressure at the requested mass flow, is performed by the controller: selecting a portion of a first compressor map for the first compressor using the requested mass flow, and identifying one or more possible first pressure ratios and first impeller speeds to determine one or more possible first compressor powers; selecting a portion of a second compressor map for the second compressor using the requested mass flow, and identifying one or more possible second pressure ratios and second impeller speeds to determine a one or more possible second compressor powers; determining a plurality of pairings of the possible first compressor powers with the possible second compressor powers, the first and second pressure ratios of each pairing delivering the desired tank pressure; determining combined powers of each pairing, each combined power being a sum of a possible first compressor power and a possible second compressor power; and selecting a pairing having the lowest combined power.

Another illustrative, non-limiting example takes the form of a multi-stage compressor system for providing pressurized gas to a tank, the tank having an inlet and an outlet coupled to at least one pressurized gas consuming apparatus, the compressor system having: a first compressor having a first inlet, a first outlet, a first impeller, and a first motor coupled to the first impeller; a second compressor having a second inlet, a second outlet, a second impeller, and a second motor coupled to the second impeller; and a controller as in any of the preceding examples; wherein the first compressor is coupled in series with the second compressor such that the first outlet feeds gas to the second inlet; wherein the second outlet is coupled to the tank.

Another illustrative, non-limiting example takes the form of a controller for multi-stage compressor system for providing pressurized gas to a tank, the tank having an outlet coupled to at least one pressurized gas consuming apparatus, the compressor system including a plurality of compressor stages each comprising a compressor having an inlet, an outlet, an impeller, and a motor, wherein the compressor stages are coupled in sequence such that a first compressor stage inlet receives ambient air, and a last compressor stage outlet is coupled to the tank, and at least one interstage connection exists between the plurality of compressor stages, the at least one interstage connection carrying gas at an interstage pressure; wherein the controller is configured to control operation of the plurality of compressors as follows: determining a requested mass flow through the compressor system; receiving a desired tank pressure and a measured ambient pressure; calculating, for each interstage connection, a target interstage pressure minimizing a sum of power used by each compressor stage to provide the requested mass flow at the tank pressure at the last compressor stage outlet; and issuing control signals to each compressor stage to yield the target interstage pressure for each interstage connection.

Additionally or alternatively, each compressor stage is a centrifugal compressor. Additionally or alternatively, the step of minimizing a sum of power is performed within compressor speed limits for each compressor stage.

Additionally or alternatively, the step of determining a requested mass flow through the compressor system is performed by the controller: receiving a requested mass flow through the system; receiving a measured mass flow through the system; and applying a proportional-integral-derivative control to calculate the requested mass flow from the requested mass flow and the measured mass flow.

Another illustrative, non-limiting example takes the form of a multi-stage compressor system for providing pressurized gas to a tank, the tank having an inlet and an outlet coupled to at least one pressurized gas consuming apparatus, the compressor system having: a plurality of compressor stages each comprising a compressor having an inlet, an outlet, an impeller, and a motor, wherein the compressor stages are coupled in sequence such that a first compressor stage inlet receives ambient air, and a last compressor stage outlet is coupled to the tank, and at least one interstage connection exists between the plurality of compressor stages, the at least one interstage connection carrying gas at an interstage pressure; and a controller as in the preceding examples.

Another illustrative, non-limiting example takes the form of a controller for a compressor system for providing pressurized gas to a tank, the tank having an outlet coupled to at least one pressurized gas consuming apparatus, the compressor system having a plurality of compressors coupled in parallel to one another to deliver compressed gas to the tank; each of the plurality of compressors characterized by a best efficiency point for operation, each respective best efficiency point having a respective mass flow and power consumption, the controller configured to control operation of the plurality of compressors by: determining and storing a plurality of optimized system operating points for the compressor system, each optimized system operating point corresponding to operation of a selected subset of the compressors at a respective best efficiency point, each of the plurality of optimized system operating points characterized by a total mass flow calculated as a sum of mass flows of the selected subset and an optimized specific energy consumption calculated as a ratio of a sum of power for the selected subset divided by the total mass flow of the optimized system operating point; determining a requested mass flow through the compressor system; identifying all optimized system operating points having a total mass flow exceeding the requested mass flow as possible first solutions; and selecting the possible first solution having the least optimized specific energy consumption as a filling configuration for use during a filling operation of the compressor system.

Additionally or alternatively, the controller is configured to maintain pressure in the air tank between a maximum limit and a minimum limit by: receiving a measured pressure in the tank; in response to the measured pressure dropping below the minimum limit, issuing control signals to execute the filling operation using the filling configuration until a measured pressure in the tank exceeds or meets the maximum limit, and then terminating the filling operation.

Additionally or alternatively, the controller is further configured to: identify any optimized system operating points having a total mass flow that is greater than zero and less than the requested mass flow and an optimized specific energy consumption that exceeds the optimized specific energy consumption of the filling solution as possible second solutions; and selecting one of the possible second solutions as a maintenance state for use in a maintenance operation.

Additionally or alternatively, the controller is configured to maintain pressure in the air tank between a maximum limit and a minimum limit by: receiving a measured pressure in the tank; in response to the measured pressure dropping below the minimum limit, issuing control signals to execute the filling operation until a measured pressure in the tank exceeds or meets the maximum limit, and then terminating the filling operation; after terminating the filling operation, executing the maintenance operation until the measured pressure drops below the minimum limit.

Additionally or alternatively, the controller is further configured to: identify any optimized system operating points having a total mass flow that is greater than zero and less than the requested mass flow and an optimized specific energy consumption that exceeds the optimized specific energy consumption of the filling solution as possible second solutions; and either: if no possible second selections are identified, determining that no maintenance state can be defined for use in a maintenance operation; or if at least one possible second selections is identified, selecting one of the possible second solutions as a maintenance state for use in a maintenance operation.

Additionally or alternatively, the controller is configured to determine, for each possible second selection, a first ratio, the first ratio being a ratio of difference between the requested mass flow and the optimized mass flow of the possible second solution, to a difference between the mass flow of the selected filling configuration and the optimized mass flow of the elected filling configuration, and determine an average specific energy consumption for each possible second selection as a sum of a product of the first ratio and an energy consumption of the filling operation, and a product of one minus the first ratio and an energy consumption of the possible second solution.

Additionally or alternatively, the controller is configured to maintain pressure in the air tank between a maximum limit and a minimum limit by: receiving a measured pressure in the tank; in response to the measured pressure dropping below the minimum limit, issuing control signals to execute the filling operation until a measured pressure in the tank exceeds or meets the maximum limit, and then terminating the filling operation; and, after terminating the filling operation, either: if no maintenance state is defined, entering a null state with all compressors off until the measured pressure drops below the minimum limit; or if a maintenance state is defined, executing the maintenance operation until the measured pressure drops below the minimum limit.

Additionally or alternatively, the controller is further configured to determine whether one or more stored optimized operating point is no longer optimal for a respective one of the compressors, if so, to determine and store a new optimized operating point for the respective one of the compressors. Additionally or alternatively, the controller determines whether one or more of stored optimized operating points is no longer optimal by observing an error or residual determined by an operations monitor.

Another illustrative and non-limiting example takes the form of a compressor system for providing pressurized gas to a tank, the tank having an outlet coupled to at least one pressurized gas consuming apparatus, the compressor system comprising: a plurality of compressors coupled in parallel to one another to deliver compressed gas to the tank, each of the plurality of compressors characterized by a best efficiency point for operation, each respective best efficiency point having a respective mass flow and power consumption; and a controller as in the preceding examples.

Still further illustrative and non-limiting examples take the form of methods of operation in a controller for a compressor system as described in the preceding examples and/or following detailed description. Additional illustrative and non-limiting examples take the form of methods of operation in a compressor system as described in the preceding examples and/or following detailed description.

This overview is intended to provide an introduction to the subject matter of the present patent application. It is not intended to provide an exclusive or exhaustive explanation. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 10 is a chart of optimized mass flow and efficiencies for a parallel multi-compressor system.

DETAILED DESCRIPTION

Figure 1:
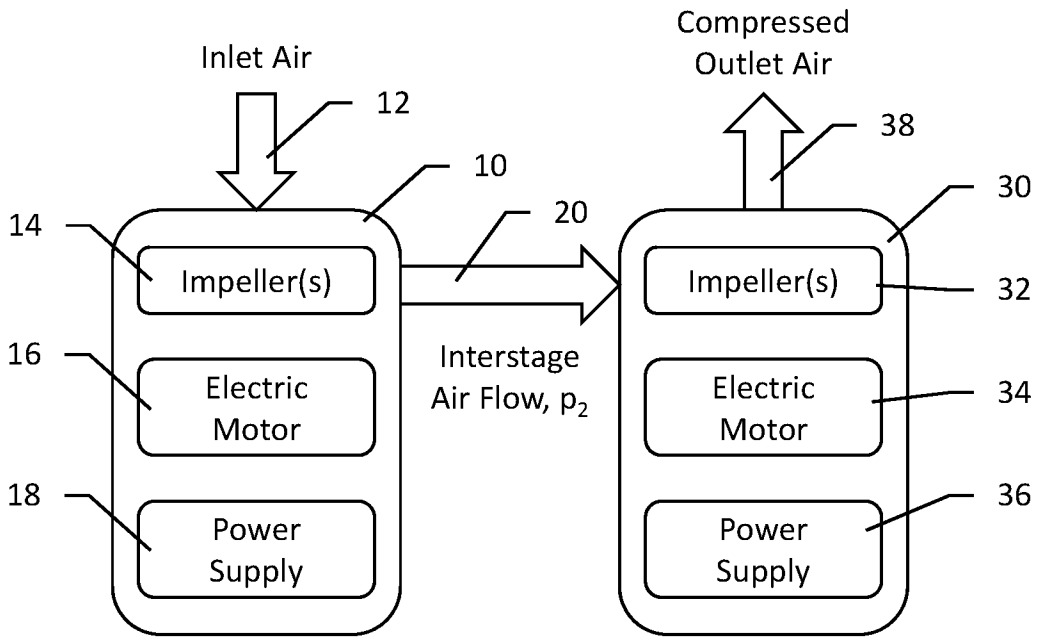
FIG. 1 shows an illustrative series multi-stage compressor system.

FIG. 1 shows an illustrative series multi-stage compressor system. The system includes a first compressor 10 in series with a second compressor 30. Inlet air 12 enters the first compressor 10 and is compressed to a higher pressure by one or more impellers 14, driven by an electric motor 16 which received current from a power supply 18. Compressed gas exits the first compressor 10 as interstage air flow 20, having an interstage mass flow and interstage pressure. For purposes below, $p_2$ is used to indicate interstage pressure. The interstage air flow 20 enters the second compressor 30 and is further compressed by impeller(s) 32, driven by an electric motor 34 receiving current from a power supply 36. The result is compressed outlet air 38.

The compressors 10, 30 may be any type of compressor useful in a system for providing compressed gas, such as, for example and without limitation, electrically driven centrifugal compressors. Though not shown, each compressor may have its own controller, taking as an inputs one or more of on/off signals, desired compressor speed, pressure ratio, target power, etc.

Some examples use two compressors 10, 30 in series as shown in FIG. 1 as a two-stage system (first compressor 10 being the first stage, and second compressor 30 being the second stage). Other examples may use more than two compressors in series, such as by having a third stage in series with the two stages shown in FIG. 1. Further, there may be multiple compressors in parallel to one another within each of a series of stages, if desired.

In some installations, the compressors may run significant part of the working day and therefore cost of energy can be high. Minimizing energy use (and therefore cost) is a goal for such systems.

As shown, the system is driven by electric motors 16, 34. Each motor can drive one or more compressor wheels. Each electric motor 16, 34 may have its own operation characteristic, limits and operating point-based efficiency map. The present inventors have recognized that, if multiple motors are used in the system, it is possible to find an operating point for each motor that will ensure delivery of requested amount of compressed air at the requested pressure levels while minimizing total energy consumption.

Figure 2:
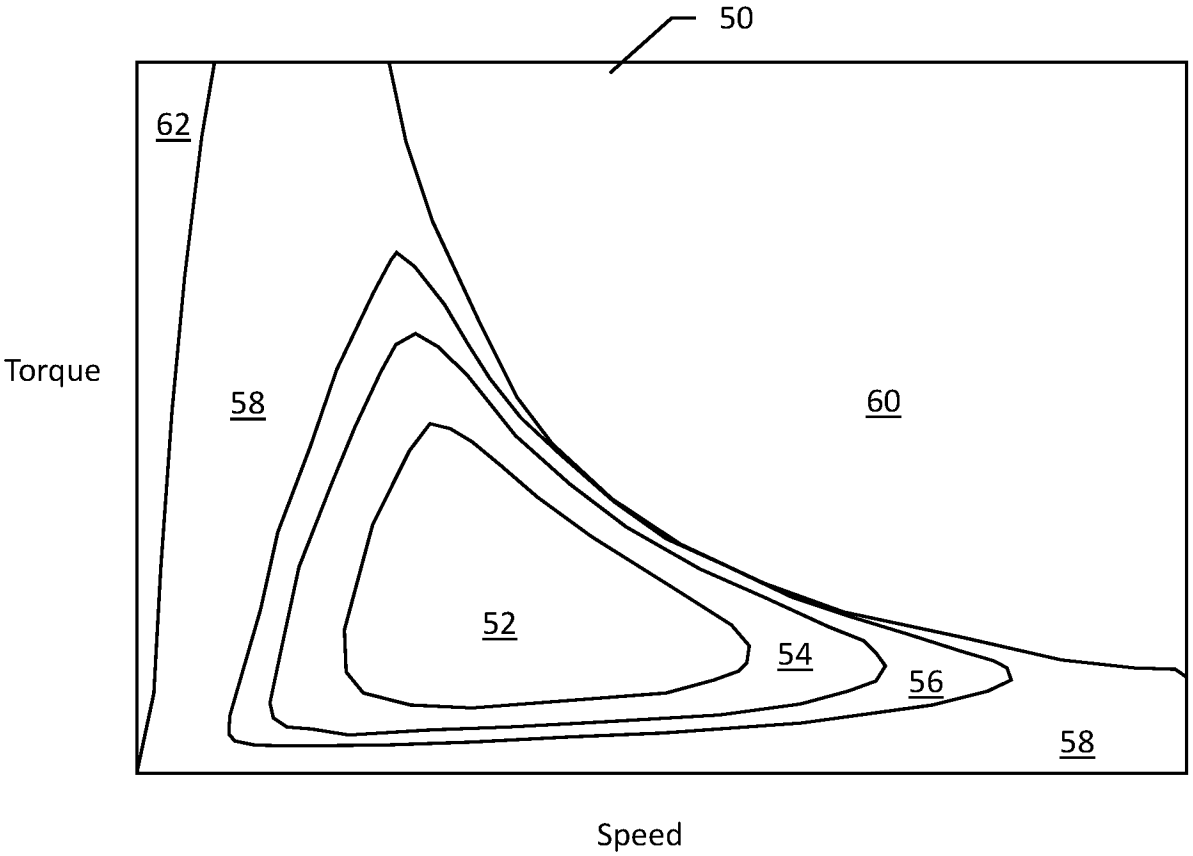
FIG. 2 shows an illustrative motor efficiency graph.

FIG. 2 shows an illustrative motor efficiency graph. An efficiency map for an electric motor is a contour plot of the electrical machine efficiency on axes of torque and speed. Each area defined at 52, 54, 56, 58 indicates levels of efficiency at speed/torque combinations. That is, the region at 52 represents highest efficiency, and efficiency is progressively less as each boundary to region 54, then 56, and 58 is crossed. Areas of non-operation at shown at 60 and 62; that is, the motor either will not operate or should not be operated in these regions 60, 62 due to physical constraints. To obtain highest efficiency, operation is desirable within region 52 (further subregions may be provided as well).

As noted, each motor in a system may have a different overall motor efficiency graph. This may be due to the use of different models, designs, brands, etc. The motor efficiency maps may also be adjusted to account for aging of the motors. For example, the map may provide an indication of a "new" motor efficiency. The system controller may monitor electric power delivered to each motor and torque (whether measured or estimated using a compressor model based on compressor speed), and adjust the motor efficiency map over time. In some examples, adjustments may be incremental stepwise adjustments in response to observed performance such as by entering various monitored parameters (current delivered, torque provided, speed, etc.) and using a Kalman filter or other data analysis to identify divergence between performance and a stored model over time, and then updating the model. In some examples, adjustments may occur by changing the motor efficiency graph over time using pre-tested models of the motor's efficiency at different points in the aging of a motor, which may be determined from manufacturer testing data, and age or performance of the motor, if desired. For example, residuals tracked by the Kalman filter may indicate changing performance norms for the compressor or compressor system. Errors or other issues may be detected using such analyses. Additionally, look-up tables may be used to, for example, monitor and determine aging characteristics that may estimate performance and performance changes over time. Finally, testing procedures may be used to identify shifting operational points for components, including motors, compressors, valves, actuators, etc.

Figure 3:
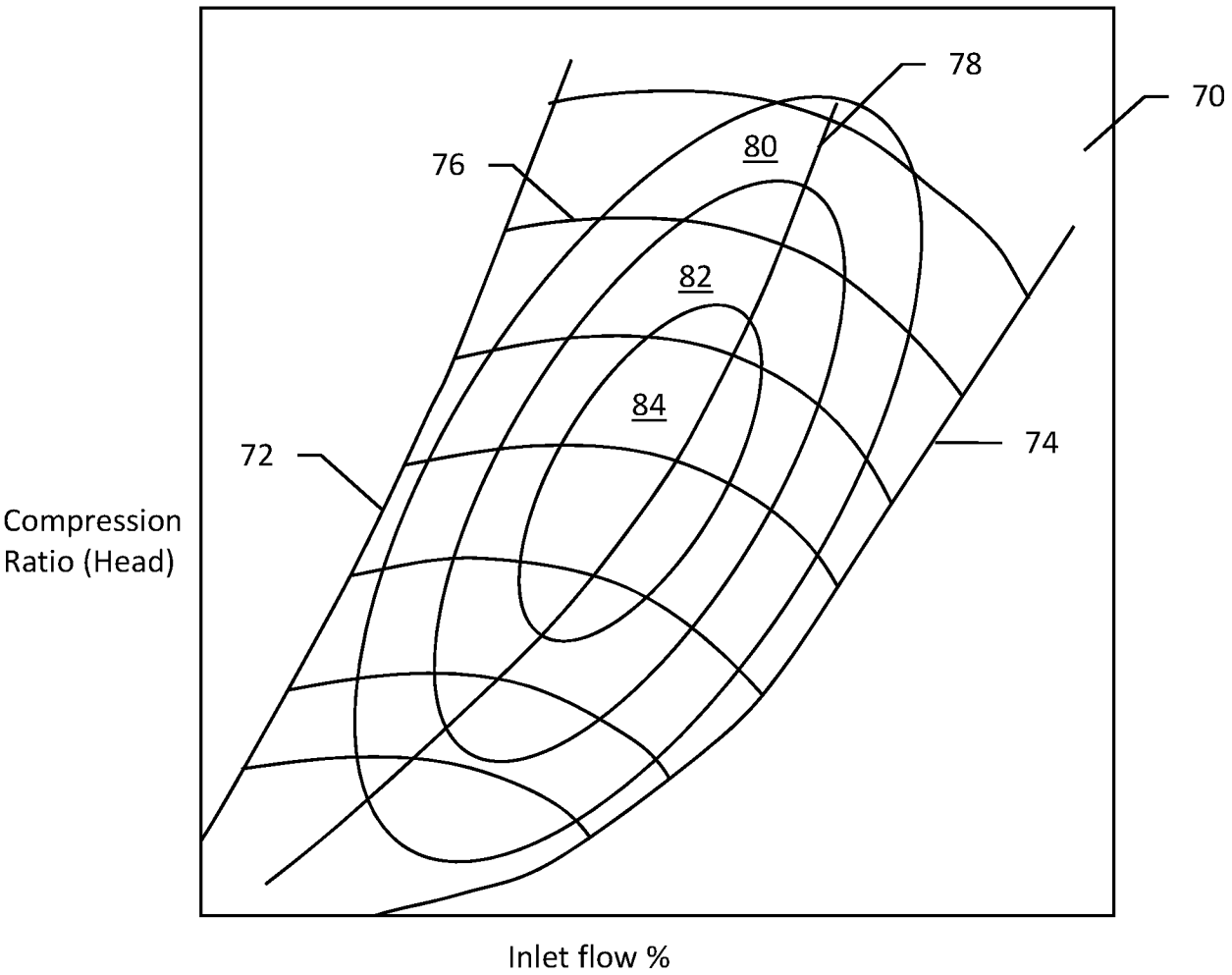
FIG. 3 shows an illustrative compressor map.

FIG. 3 shows an illustrative compressor map. A compressor map is a contour plot of the efficiency of the compressor at different compression ratios or head (the ratio of pressure out to pressure in), versus inlet flow as a percentage of maximum mass flow and/or versus corrected mass flow. The illustrative map 70 shows a choke line 74 and a surge line 72, each representing operating boundaries outside of which the compressor should not be operated or cannot operate. For example, crossing the surge line 72 can lead to cavitation and damage to the compressor blades, wheel or other components. The horizontal curves 76 represent compressor speeds, increasing in the upward direction on the Figure.

Efficiency islands are shown at 80, 82, 84, with the highest efficiency in the centermost island 84. It is desirable to operate in the highest efficiency island 84 and/or at the highest efficiency available for a given speed, illustrated as peak efficiency line 78.

Each compressor in the system may have a different compressor map. This may be due to different compressor designs, brands, etc. In addition, each compressor is also subject to aging over time. The compressor map as shown may be for a new compressor. Over time, aging may cause shifting of one or more of the lines for a given build. The system controller may, for example, monitor temperature, pressure, and/or compressor speed during operation to determine whether actual performance matches the map. As the compressor ages, the compressor map may be updated. Updates may occur by swapping out one map for another as the compressor ages, using test stand data developed for compressors at different ages. Updates may instead occur by the system controller monitoring performance and using a Kalman filter, or other analysis, to identify divergence between performance and a stored model over time, and then updating the model.

Figure 4:
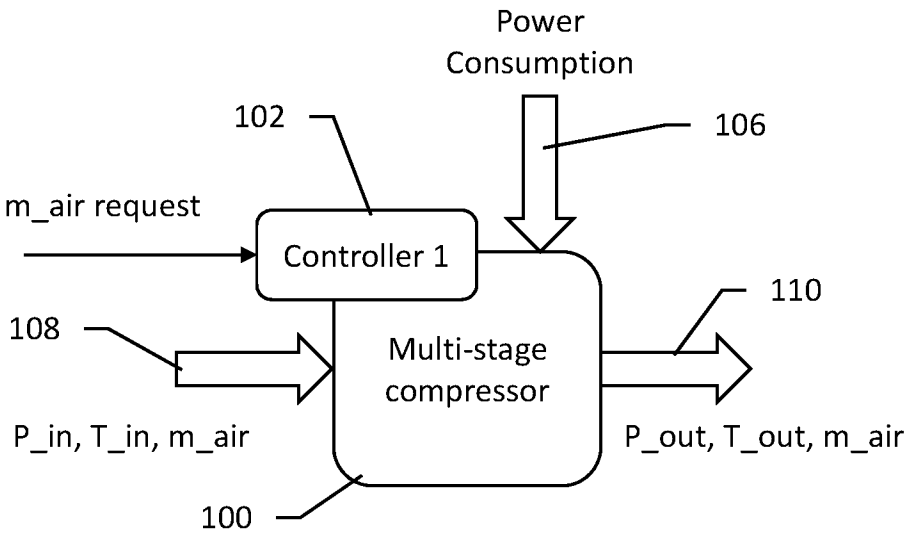
FIG. 4 shows an illustrative compressor control model.

FIG. 4 shows an illustrative compressor control model. The control objective in this example is to deliver requested air mass flow while respecting multi-stage compressor limits for safe operation, and with minimum electric power. Boundary conditions 108 are given by inlet air pressure (P_in), inlet air temperature (T_in) and outlet pressure (given by air tank pressure), each of which may be derived from sensors located to obtain such data. In case of multiple compressors connected in series, there are multiple motors and therefore there is, for each mass flow, a near infinite number of combinations of compressor speeds that can achieve requested mass flow (m_air request) for fixed boundary conditions. The objective for the controller 102 is to split the load between the individual motors in order to minimize electric power 106. The multi-stage compressor system 100 then provides the mass flow (m_air) as the desired output 110, with boundary conditions for output pressure (P_out), and/or output temperature (T_out), as shown.

Figure 5:
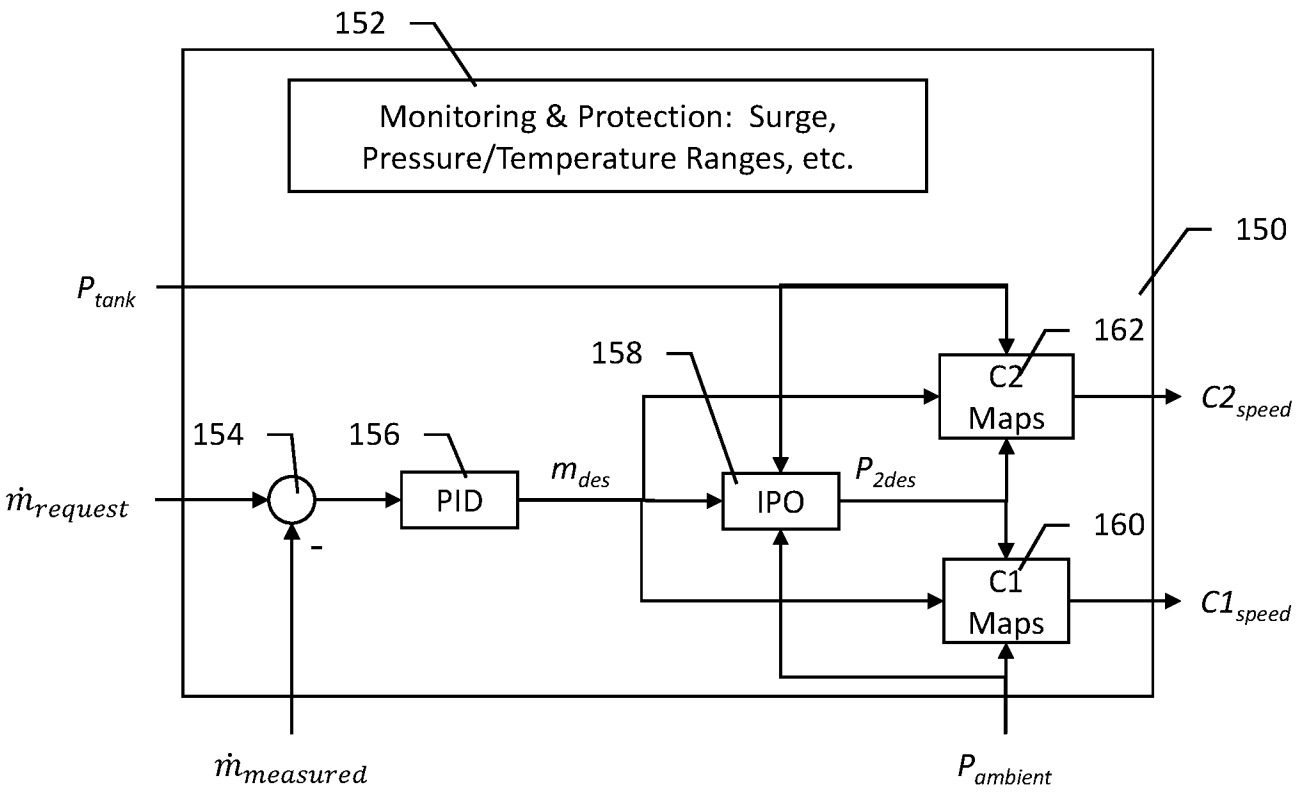
FIG. 5 shows an illustrative controller configuration.

FIG. 5 shows an illustrative controller configuration. The configuration here is for two series compressors. The controller 150 operates in accordance with monitoring and protection bounds 152, avoiding for example surge and any operation outside of ranges for pressure and temperature. Requested mass flow $\dot{m}_{request}$ and measured mass flow $\dot{m}_{measured}$ are subtracted at 154 and the difference input to a proportional-integral-derivative control 156 to determine a current desired mass flow ($m_{des}$). This value is fed to the interstage pressure optimizer (IPO) 158. The IPO 159 will determine the desired interstage pressure, $p_{2des}$ as a function of the ambient pressure, $P_{ambient}$, the tank pressure $P_{tank}$, as well as other variables as needed Compressor map inversion is then performed to obtain the target speed for all compressors.

The controller may take many forms, including, for example, a microcontroller or microprocessor, coupled to a memory storing readable instructions for performing methods as described herein, as well as providing configuration of the controller 150 for the various examples that follow. The controller 150 may include one more application-specific integrated circuits (ASIC) to provide additional or specialized functionality, such as, without limitation a signal processing ASIC that can filter received signals from one or more sensors using digital filtering techniques. Logic circuitry, state machines, and discrete or integrated circuit components may be included as well. The skilled person will recognize many different hardware implementations are available for a controller 150. The controller 150 may be part of a computer (desktop, laptop, etc.) provided as part of the overall pressurized air delivery system.

For the first compressor in the series, C1, the compressor flow map is used at 160 to determine a desired speed, $C1_{speed}$, by identifying the pressure ratio using $p_{2des}$ and the ambient pressure $P_{ambient}$. From the first compressor pressure ratio and the desired mass flow $m_{des}$, the compressor speed can be determined. For the second compressor in the series, the compressor flow map is used at 162 to determine a desired speed, $C2_{speed}$, by identifying the pressure ratio using $p_{2des}$ and the tank pressure, $P_{tank}$. From the second compressor pressure ratio and the desired mass flow $m_{des}$, the second compressor speed can be determined using the compressor flow map. Each compressor flow map 160, 162 may incorporate each of a motor efficiency map and a compressor map, if desired.

The IPO 158 operates in an illustrative example as follows. In the general case of serial connection of n compressors, the minimization problem can use this form:

$$\min_{Pin_i} J = \sum_{i=1}^{n} Pwr_i(Pin_i, Pout_i, \omega_i, \dot{m})$$

Where for each compressor (i), the compressor overall power consumption (Pwr) is determined from the input pressure $Pin_i$, output pressure $Pout_i$, speed $w_i$, and mass flow, $\dot{m}$. This cost function has the following compressor speed limit constraint:

$$\omega_{imin} \leq \omega_i \leq \omega_{imax}$$

The air mass flow is fixed to demand:

$$\dot{m} = \dot{m}_{request}$$

Inlet pressure of the first compressor is set to ambient:

$$P_{in1} = P_{ambient}$$

And outlet pressure of the last compressor is equal to tank pressure:

$$P_{outn} = P_{tank}$$

Within this analysis then, the target air mass flow can be provided for a given set of boundary conditions (ambient and tank pressures, and mass flow) by multiple settings of the interstage pressure, $P_i$. The IPO 158 selects this interstage pressure using the above set of formulas. The target speed of individual compressors is then calculated using the optimized interstage pressure $P_i$.

Figure 6:
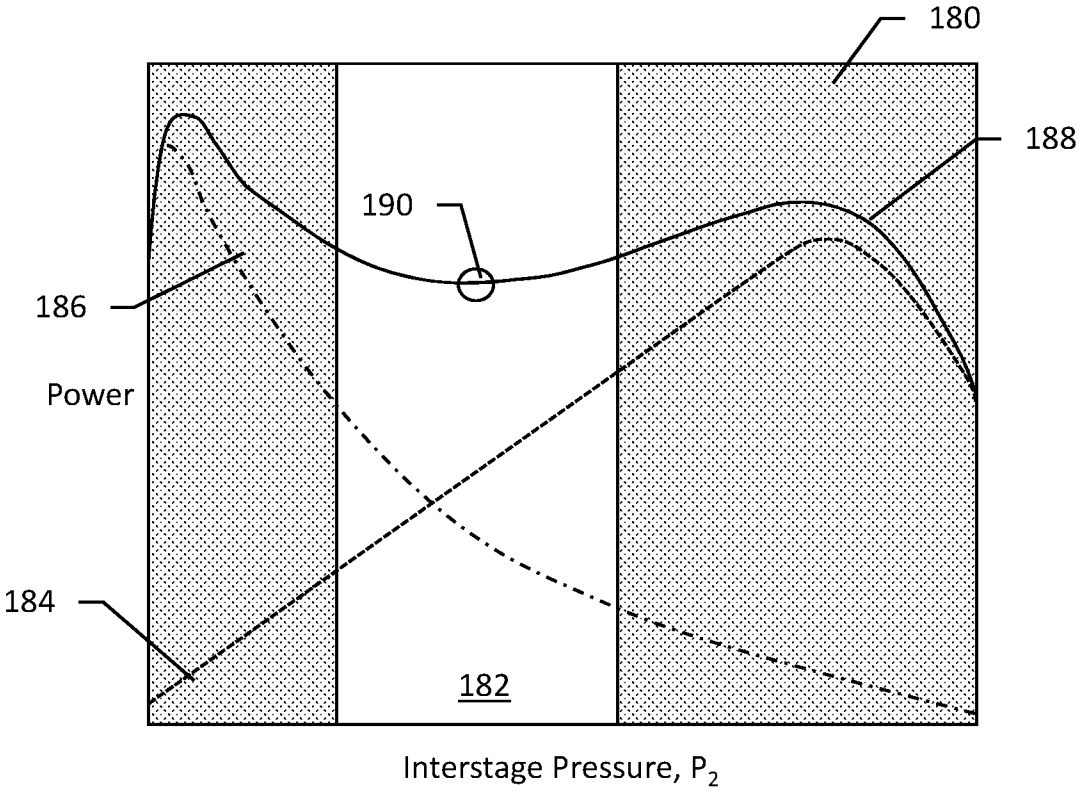
FIG. 6 shows an illustrative system performance graph.

FIG. 6 shows an illustrative system performance graph 180 for a two-compressor series configuration. Region 182 is the feasible region, that is, the region in which the compressors can each be operated without violating a boundary condition for the electric motors and/or the compressors thereof. The power consumed by each of the stages at a given interstage pressure $p_2$ is illustrated by a first compressor power line 184 and a second compressor power line 186. For example, if the interstage pressure $p_2$ is very low, the second compressor provides all the power (thus line 186 descends from left to right). Line 188 sums the two compressor powers 184, 186. The optimal operating point is shown at 190, in which line 188 is at its lowest level within the feasible operating zone 182.

The visual of FIG. 6 is helpful to understand the solution for a two-stage system. More than two stages can be used, as desired. The IPO 158 (FIG. 5) is configured to identify the optimal operating point 190 by solving the above described minimization problem to identify the operating points that achieve optimal operation. With two stages, a $P_{2des}$ output drives the solution. With more than two stages, the inlet pressure of the first stage is the ambient pressure, the outlet pressure of the last stage would be the tank pressure, and there would be multiple interstage values, in which $Pout_i = Pin_{i+1}$, that is, the output pressure of the $i^{th}$ stage would be the inlet pressure of the subsequent stage.

FIGS. 1-6 thus illustrate the case of a multi-stage compressor system with compressors in series. Other systems may use parallel compressors. FIGS. 7-10 show another example.

Figure 7:
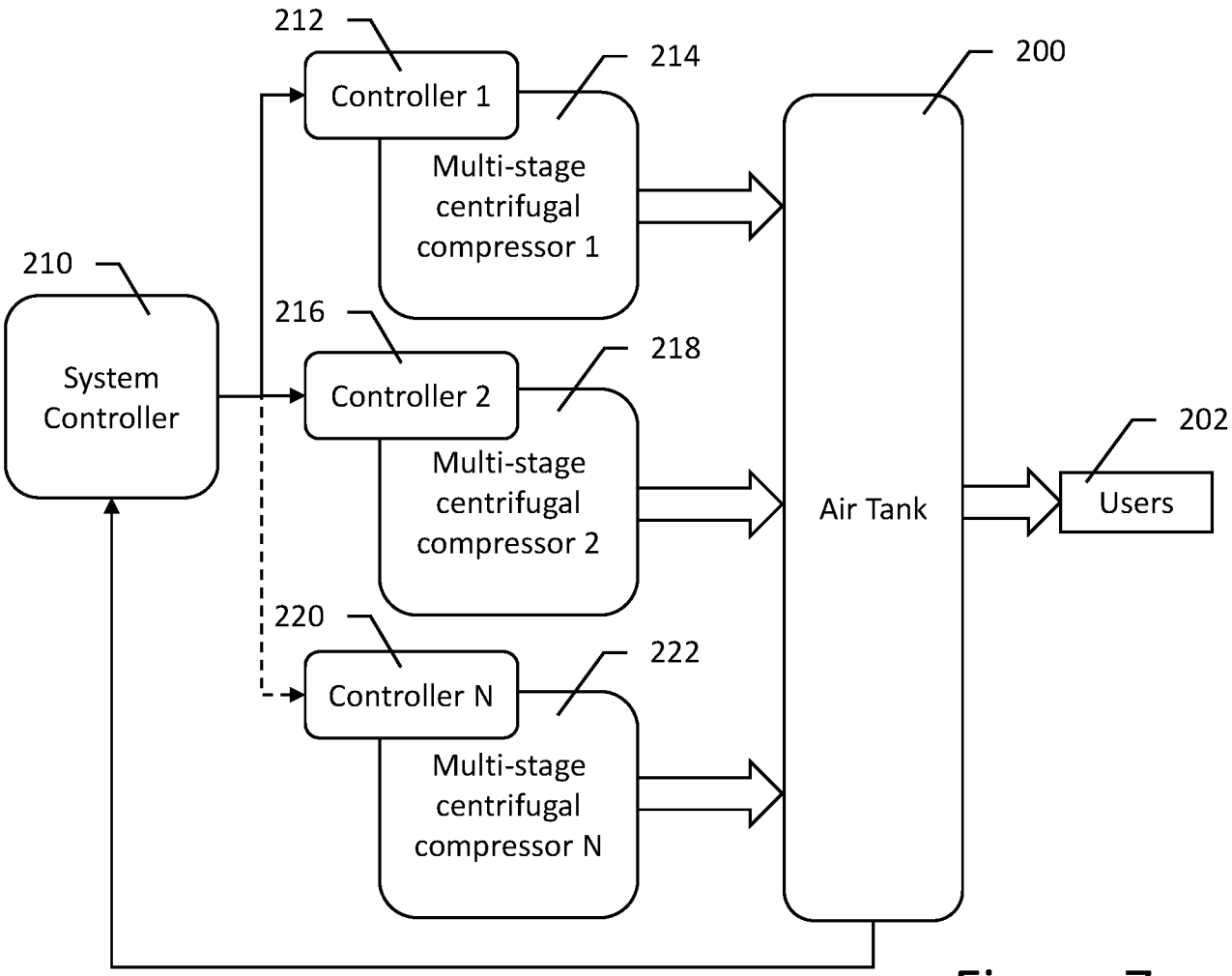
FIG. 7 shows an illustrative parallel multi-compressor system.

FIG. 7 shows an illustrative parallel multi-compressor system. An air tank 200 provides compressed air to one or more "users" 202, which may be, for example and without limitation, machines in an industrial plant, such as may be used for manufacturing. A system controller 210 provides operation instructions for a first controller 212 that controls a first compressor 214, a second controller 216 that controls a second compressor 218, and so further, until an $N^{th}$ controller 220 which controls another compressor 222. Each compressor 214, 218, 222 is described in the Figure as a multi-stage centrifugal compressor. In other examples other compressor types and layouts may be used; at a high level of generality, each of 214, 218, 222 may be a compressor of any type or design. In this example, each of the individual compressors 214, 218, 222 is characterized by a range of operating points and efficiencies.

Each controller 210, 212, 216, 220 may use the hardware described previously, including any of microcontroller, microprocessor, ASIC, computer and associated analog or digital circuitry logic, circuitry and memory.

The system controller 210 is tasked with maintaining a pressure target in the air tank 200 by requesting and coordinating tank inlet air mass flow from the compressors 214, 218, 222. The control strategy is focused on energy consumption minimization while respecting all technology and safety limits. Each compressor 214, 218, 222 may have different characteristic in terms of efficiency, for example due to different mass flow capacity. An on/off mode may be used in some examples.

Figure 8:
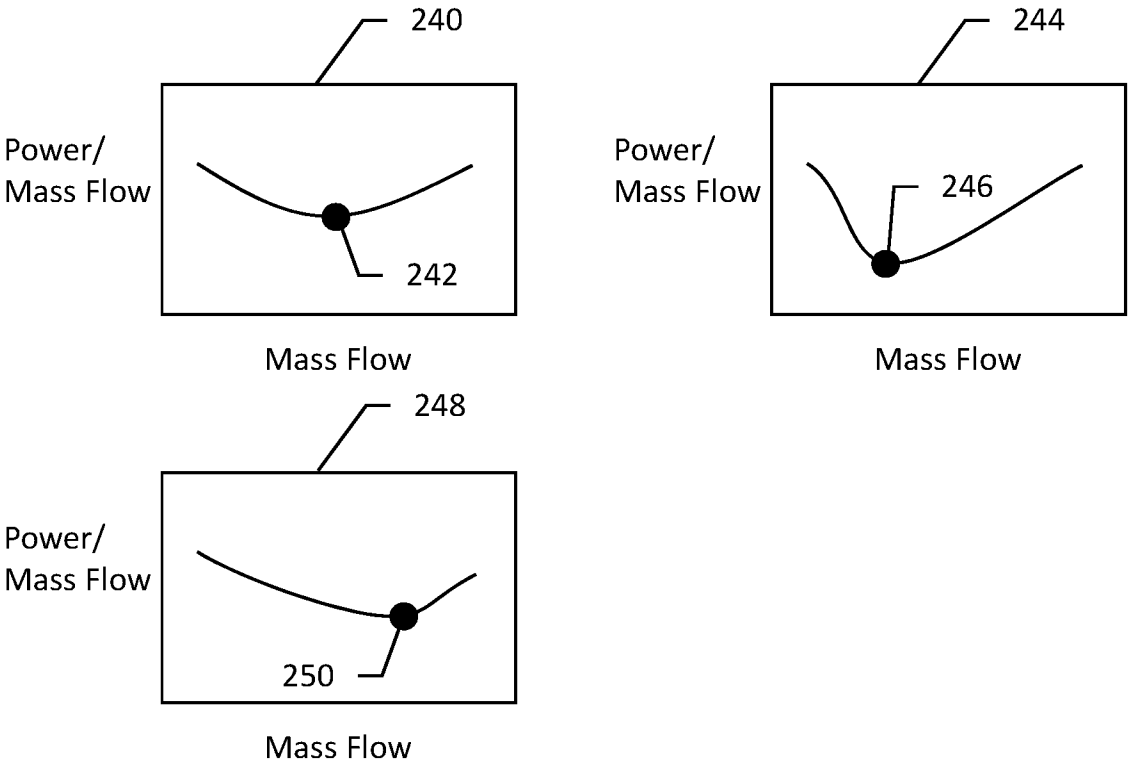
FIG. 8 shows illustrative efficiency and mass flow of several compressors.

FIG. 8 shows illustrative efficiency and mass flow of several compressors in graphs with a vertical axis showing a ratio of power to mass flow, and a horizontal axis for mass flow. At 240, a first compressor efficiency graph is shown, with a most efficient operating point at 242—that is, the lowest power to mass flow is at point 242. At 244, a second compressor efficiency graph is shown, with a most efficient operating point at 246, and at 248, a third compressor efficiency graph is shown, with a most efficient operating point at 250.

Figure 9:
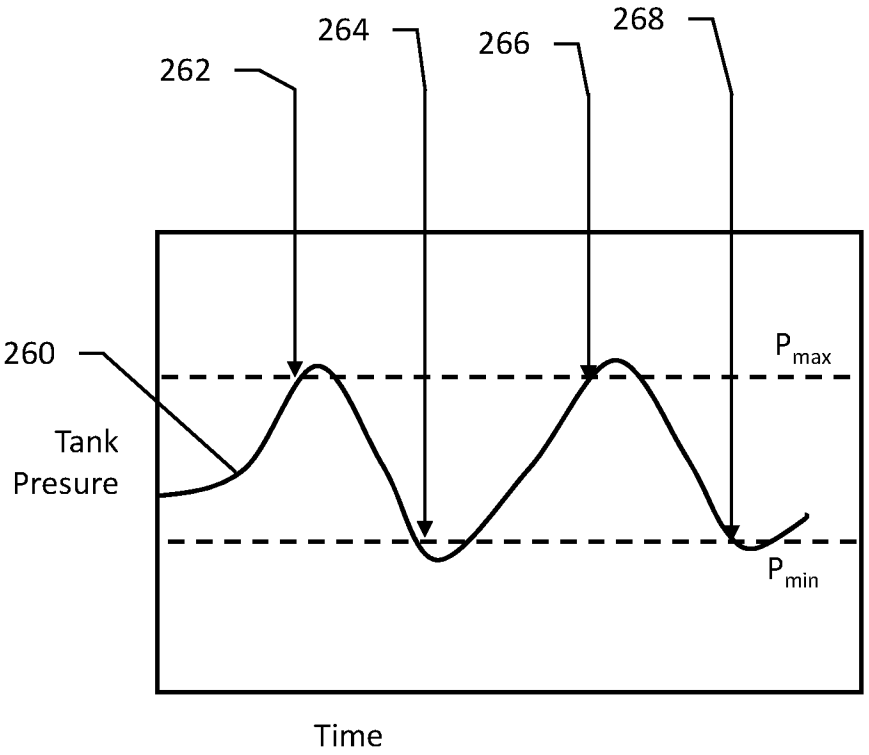
FIG. 9 illustrates use of a two-state control approach.

FIG. 9 illustrates use of a two-state control approach. Here a first state is a filling state, in which the tank is pressurized toward a maximum tank pressure setting by supplying a mass flow to the tank that exceeds the outgoing mass flow to the user(s). A second state is a maintenance state in which either no mass flow to the tank is provided, or a mass flow which is less than that of the outgoing mass flow to the users. This control approach may not actually attempt to match mass flow into the tank to that going out and instead contemplates increasing and decreasing the mass flow into the tank within two boundaries defined in the graph as maximum pressure ($P_{max}$) and minimum pressure ($P_{min}$). The boundaries may be set to ensure adequate pressure for each user of the system to have reliable operation of the machine in use by each user.

Line 260 shows the tank pressure at any given point in time. When tank pressure line 260 is increasing, the filling state can be inferred, and when tank pressure line 260 is decreasing, the maintenance state can be inferred. That is, as the tank pressure line 260 rises in the filling state, when the $P_{max}$ line is met, the filling state ceases, and the maintenance state is used. A selected set of the compressors is used in each state, and the mass flow of the selected compressors that are "ON" in the maintenance state is less than the mass flow of the selected compressors that are "ON" in the filling state.

As a result, and as shown in FIG. 9, line 260 slopes upward until $P_{max}$ line is met at time 262. The filling state is replaced with the maintenance state, and line 260 slopes down until the $P_{min}$ line is met at time 264. The process repeats, with a state transition at 266 (filling to maintenance) and again at 268 (maintenance to filling).

FIG. 10 is a chart of optimized mass flow and efficiencies for a parallel multi-compressor system. This chart 300 is used to determine which compressors to use in each of the filling and maintenance states. Each configuration 302 determines state of each of a set of three compressors C1 (state shown at 304 as ON or OFF), C2 (state shown at 306 as ON or OFF), and C3 (state shown at 308 as ON or OFF). The mass flow for each configuration is shown at 310, and the specific energy consumption of each configuration, which is calculated as the total power used in each configuration divided by the mass flow of each configuration, is shown at 312.

In the table 300, only the maximum efficiency operating points are shown. Thus each configuration assumes that any compressor which is active is operated at its maximum efficiency. Maximum efficiency for a compressor combines both motor operation (FIG. 2) and compressor map (FIG. 3), based on mass flow divided by power. The largest mass flow, M* is when all three compressors are on and each operating using maximum efficiency operating points, that is, configuration 7.

Figure 11:
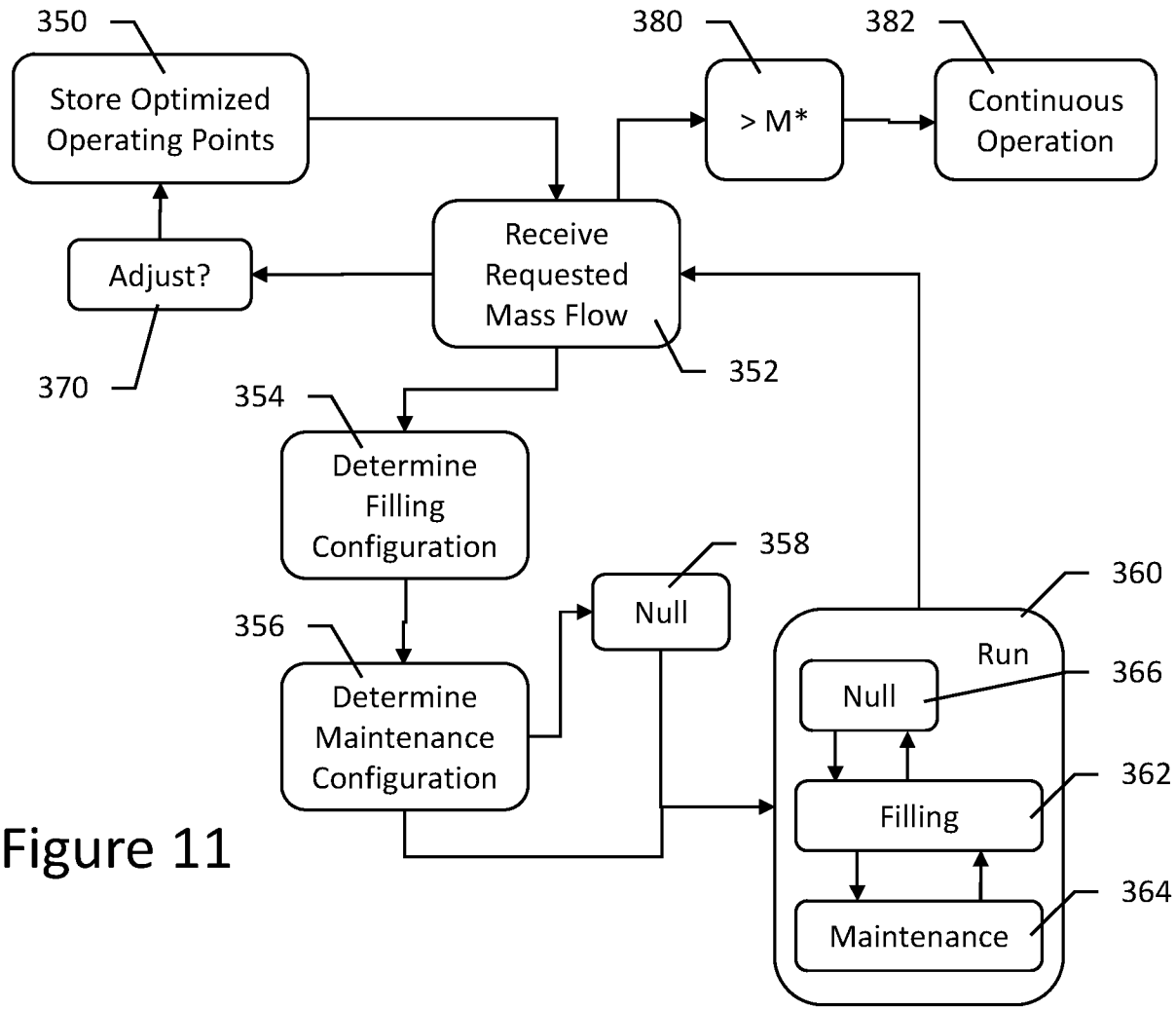
FIG. 11 show an illustrative method in block form.

The control method then is as shown in FIG. 11. At 350, the controller is configured to store the optimized operating points for a plurality of compressors in the system. This may include, for example, populating a data table as illustrated in FIG. 10 and storing such data in a non-transitory machine-readable memory, such as a Flash, RAM, ROM or other data storage system/subsystem. A requested mass flow is received at 352. The controller then determines a filling configuration at 354, and also determines a maintenance configuration at 356.

Block 354 may include the following. First, all combinations from the stored data table (FIG. 10) with mass flows higher than or equal to the requested air mass flow are identified. From this selected group, the combination that has the lowest energy consumption is selected for use as the filling configuration. If the requested mass flow from 352 exceeds the highest mass flow in the stored data table (FIG. 10), the method exits to 380 since the mass flow request cannot be fulfilled using the optimized operating points of the compressors in the system.

Block 356 may include a different assessment. Here, all combinations from the stored data table (FIG. 10) with mass flows less than the requested mass flow are selected. It may be noted that this selected group would exclude the null operation (all compressors off); that is, each combination considered has a mass flow greater than zero in some examples. Any of the combinations that have a specific energy consumption that exceeds the specific energy consumption of the selected "filling" configuration (from block 354) are eliminated. This means that only those configurations giving better efficiency than that used for filling can be used in the maintenance stage, minimizing power consumption. If this leaves only the null configuration, rather than selecting a maintenance configuration, the method selects the null configuration 358 and the state transition during run 360 would be from the filling configuration 362 to a null state 366 in which all compressors are in the off state.

Otherwise a further analysis occurs. First, an alpha parameter is calculated for each of the remaining combinations:

$$\alpha_i = \frac{m_{req} - M_i}{M_{on} - M_i}$$

Where $m_{req}$ is the requested mass flow, $M_{on}$ is the mass flow of the selected filling configuration, and $M_i$ is the mass flow of the $i^{th}$ remaining available configuration. Each alpha parameter thus indicates the ratio of times the system would be in each of the fill and maintenance states. Next, an average specific energy consumption for each combination is determined:

$$E_{avg,i} = \alpha E_{on} + (1 - \alpha_i)E_i$$

Where $E_{on}$ is the energy consumed by the selected filling configuration, and $E_i$ is the energy consumed by the $i^{th}$ remaining available configuration. Finally, the configuration having the least average specific energy consumption is chosen for use as the maintenance configuration.

With the filling configuration determined at 354, and the maintenance configuration determined at 356, the system then goes to a run state, at 360, in which operations alternate as shown in FIG. 9 between the filling state 362 and maintenance state 364. If no maintenance state 364 is defined, the transitions in the run state 360 would be between filling 362 and a null state 366 in which all compressors are off. If a new mass flow request is received, or if the controller determines that the tank is not staying within desired bounds (such as if for whatever reason the filling state is not keeping up), an interrupt may be generated and the system returns form the run state 360 to block 352.

From time to time, or in response to performance observations, the controller may determine a need to adjust 370 the stored optimized operating points 350. Each compressor and associated hardware is subject to aging over time. Over time, aging may cause shifting of one or more of the optimized operating points for a given compressor, and this may trigger use of a new model requiring updating of the stored data at block 350. Performance may trigger adjustment 370 as well. The system controller may, for example, monitor temperature, pressure, and/or compressor speed during operation to determine whether actual performance matches a model. Updates may occur by swapping out one map for another as the compressor ages, using test stand data developed for compressors at different ages. Updates may instead occur by the system controller monitoring performance and using a Kalman filter or other data analysis to identify divergence between performance and a stored model over time, and then updating the model. For example, residuals tracked by the Kalman filter may indicate changing performance norms for the compressor or compressor system. Errors or other issues may be detected using such analyses. Additionally, look-up tables may be used to, for example, monitor and determine aging characteristics that may estimate performance and performance changes over time. Finally, testing procedures may be used to identify shifting operational points for components, including motors, compressors, valves, actuators, etc.

In some illustrative examples, if the mass flow request exceeds M*, as indicated at 380, and cannot be fulfilled with all compressors operating at their highest efficiency points, an alternative analysis, such as a continuous operation control strategy 382 may be used. One example may use model predictive control (MPC), as a continuous operation strategy 382. For example, MPC may use a cost function minimization, with predicted future actions considered (for example, tank filling and discharge, and, if available, user preview information), to find control actions in a continuous operation control strategy.

Each of these non-limiting examples can stand on its own, or can be combined in various permutations or combinations with one or more of the other examples. The above detailed description includes references to the accompanying drawings, which form a part of the detailed description. The drawings show, by way of illustration, specific embodiments. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." Moreover, in the claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic or optical disks, magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, innovative subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the protection should be determined with reference to the appended claims, along with the full scope of equivalents to which such claims are entitled.

What is claimed is:

1. A controller for multi-stage compressor system for providing pressurized gas to a tank, the tank having an outlet coupled to at least one pressurized gas consuming apparatus, the compressor system having:

a first compressor having a first inlet, a first outlet, a first impeller, and a first motor coupled to the first impeller;

a second compressor having a second inlet, a second outlet, a second impeller, and a second motor coupled to the second impeller;

wherein the first compressor is coupled in series with the second compressor such that the first outlet feeds gas to the second inlet;

wherein the controller is configured to control operation of the first and second compressors as follows:

determining a requested mass flow through the compressor system;

receiving a desired tank pressure and a measured ambient pressure;

calculating a target interstage pressure for gas fed from the first outlet to the second inlet by minimizing a sum of power used by the first compressor to obtain a first pressure ratio of ambient pressure to target interstage pressure at the requested mass flow, and power used by the second compressor to obtain a second pressure ratio of target interstage pressure to tank pressure at the requested mass flow; and controlling by control signals issued by the controller, the first and second compressors to achieve the target interstage pressure.

2. The controller of claim 1, wherein the first compressor is a centrifugal compressor, and the second compressor is a centrifugal compressor.

3. The controller of claim 1, wherein the step of minimizing a sum of power is performed within compressor speed limits for each of the first compressor and the second compressor.

4. The controller of claim 1, wherein the step of determining a requested mass flow through the compressor system is performed by the controller:

receiving a requested mass flow through the system;

receiving a measured mass flow through the system; and applying a proportional-integral-derivative control to calculate the requested mass flow from the requested mass flow and the measured mass flow.

5. The controller of claim 1, wherein the step of minimizing a sum of power used by the first compressor to obtain a first pressure ratio of ambient pressure to target interstage pressure at the requested mass flow, and power used by the second compressor to obtain a second pressure ratio of target interstage pressure to tank pressure at the requested mass flow, is performed by the controller:

selecting a portion of a first compressor map for the first compressor using the requested mass flow, and identifying one or more possible first pressure ratios and first impeller speeds to determine a one or more possible first compressor powers;

selecting a portion of a second compressor map for the second compressor using the requested mass flow, and identifying one or more possible second pressure ratios and second impeller speeds to determine a one or more possible second compressor powers;

determining a plurality of pairings of the possible first compressor powers with the possible second compressor powers, the first and second pressure ratios of each pairing delivering the desired tank pressure;

determining combined powers of each pairing, each combined power being a sum of a possible first compressor power and a possible second compressor power; and selecting a pairing having the lowest combined power.

6. A multi-stage compressor system for providing pressurized gas to a tank, the tank having an inlet and an outlet coupled to at least one pressurized gas consuming apparatus, the compressor system having:

a first compressor having a first inlet, a first outlet, a first impeller, and a first motor coupled to the first impeller;

a second compressor having a second inlet, a second outlet, a second impeller, and a second motor coupled to the second impeller; and a controller as in claim 1;

wherein the first compressor is coupled in series with the second compressor such that the first outlet feeds gas to the second inlet;

wherein the second outlet is coupled to the tank.

7. A controller for multi-stage compressor system for providing pressurized gas to a tank, the tank having an outlet coupled to at least one pressurized gas consuming apparatus, the compressor system including a plurality of compressor stages each comprising a compressor having an inlet, an outlet, an impeller, and a motor, wherein the compressor stages are coupled in sequence such that a first compressor stage inlet receives ambient air, and a last compressor stage outlet is coupled to the tank, and at least one interstage connection exists between the plurality of compressor stages, the at least one interstage connection carrying gas at an interstage pressure;

wherein the controller is configured to control operation of the plurality of compressors as follows:

determining a requested mass flow through the compressor system;

receiving a desired tank pressure and a measured ambient pressure;

calculating, for each interstage connection, a target interstage pressure minimizing a sum of power used by each compressor stage to provide the requested mass flow at the tank pressure at the last compressor stage outlet; and controlling each compressor stage by the controller issuing control signals, to achieve the target interstage pressure for each interstage connection.

8. The controller of claim 7, wherein each compressor stage is a centrifugal compressor.

9. The controller of claim 7, wherein the step of minimizing a sum of power is performed within compressor speed limits for each compressor stage.

10. The controller of claim 7, wherein the step of determining a requested mass flow through the compressor system is performed by the controller:

receiving a requested mass flow through the system;

receiving a measured mass flow through the system; and applying a proportional-integral-derivative control to calculate the requested mass flow from the requested mass flow and the measured mass flow.

11. A multi-stage compressor system for providing pressurized gas to a tank, the tank having an inlet and an outlet coupled to at least one pressurized gas consuming apparatus, the compressor system having:

a plurality of compressor stages each comprising a compressor having an inlet, an outlet, an impeller, and a motor, wherein the compressor stages are coupled in sequence such that a first compressor stage inlet receives ambient air, and a last compressor stage outlet is coupled to the tank, and at least one interstage connection exists between the plurality of compressor stages, the at least one interstage connection carrying gas at an interstage pressure; and a controller as in claim 7.

12. A controller for a compressor system for providing pressurized gas to a tank, the tank having an outlet coupled to at least one pressurized gas consuming apparatus, the compressor system having a plurality of compressors coupled in parallel to one another to deliver compressed gas to the tank; each of the plurality of compressors characterized by a best efficiency point for operation, each respective best efficiency point having a respective mass flow and power consumption, the controller configured to control operation of the plurality of compressors by:

determining and storing a plurality of optimized system operating points for the compressor system, each optimized system operating point corresponding to operation of a selected subset of the compressors at a respective best efficiency point, each of the plurality of optimized system operating points characterized by a total mass flow calculated as a sum of mass flows of the selected subset and an optimized specific energy consumption calculated as a ratio of a sum of power for the selected subset divided by the total mass flow of the optimized system operating point;

determining a requested mass flow through the compressor system;

identifying all optimized system operating points having a total mass flow exceeding the requested mass flow as possible first solutions; selecting the possible first solution having the least optimized specific energy consumption as a filling configuration for use during a filling operation of the compressor system; and controlling, by control signals issued by the controller, a filling operation of the compressor system to achieve the filling configuration with the plurality of compressors.

13. The controller of claim 12, wherein the controller is configured to maintain pressure in the air tank between a maximum limit and a minimum limit by:

receiving a measured pressure in the tank;

in response to the measured pressure dropping below the minimum limit, issuing control signals to execute the filling operation using the filling configuration until a measured pressure in the tank exceeds or meets the maximum limit, and then terminating the filling operation.

14. The controller of claim 12, wherein the controller is further configured to:

identify any optimized system operating points having a total mass flow that is greater than zero and less than the requested mass flow and an optimized specific energy consumption that exceeds the optimized specific energy consumption of the filling solution as possible second solutions; selecting one of the possible second solutions as a maintenance state for use in a maintenance operation; and controlling, by control signals issued by the controller, a maintenance operation of the compressor system to achieve the maintenance state.

15. The controller of claim 14, wherein the controller is configured to maintain pressure in the air tank between a maximum limit and a minimum limit by:

receiving a measured pressure in the tank;

in response to the measured pressure dropping below the minimum limit, issuing control signals to execute the filling operation until a measured pressure in the tank exceeds or meets the maximum limit, and then terminating the filling operation;

after terminating the filling operation, executing the maintenance operation until the measured pressure drops below the minimum limit.

16. The controller of claim 12, wherein the controller is further configured to:

identify any optimized system operating points having a total mass flow that is greater than zero and less than the requested mass flow and an optimized specific energy consumption that exceeds the optimized specific energy consumption of the filling solution as possible second solutions; and either:

if no possible second selections are identified, determining that no maintenance state can be defined for use in a maintenance operation; or if at least one possible second selections is identified, selecting one of the possible second solutions as a maintenance state for use in a maintenance operation; and controlling, by control signals issued by the controller, a maintenance operation of the compressor system to achieve the maintenance state.

17. The controller of claim 16, wherein the controller is configured to maintain pressure in the air tank between a maximum limit and a minimum limit by:

receiving a measured pressure in the tank;

in response to the measured pressure dropping below the minimum limit, issuing control signals to execute the filling operation until a measured pressure in the tank exceeds or meets the maximum limit, and then terminating the filling operation; and, after terminating the filling operation, either:

if no maintenance state is defined, entering a null state with all compressors off until the measured pressure drops below the minimum limit; or if a maintenance state is defined, executing the maintenance operation until the measured pressure drops below the minimum limit.

18. The controller of claim 12, wherein the controller is further configured to determine whether one or more stored optimized operating point is no longer optimal for a respective one of the compressors, if so, to determine and store a new optimized operating point for the respective one of the compressors.

19. The controller of claim 12, wherein the controller determines whether one or more of stored optimized operating points is no longer optimal by observing an error or residual determined by an operations monitor.

20. A compressor system for providing pressurized gas to a tank, the tank having an outlet coupled to at least one pressurized gas consuming apparatus, the compressor system comprising:

a plurality of compressors coupled in parallel to one another to deliver compressed gas to the tank, each of the plurality of compressors characterized by a best efficiency point for operation, each respective best efficiency point having a respective mass flow and power consumption; and a controller as in claim 12.

* * * * *